US005989800A

United States Patent [19]

Hosoya et al.

[11] Patent Number: 5,989,800

[45] Date of Patent: Nov. 23, 1999

[54] PROCESS FOR PRODUCING TABULAR SILVER HALIDE GRAINS

[75] Inventors: Yoichi Hosoya; Junichi Yamanouchi, both of Kanagawa, Japan

[73] Assignee: Fuji Photo Film Co., Ltd, Kanagawa, Japan

[21] Appl. No.: 08/961,951

[22] Filed: Oct. 31, 1997

[30] Foreign Application Priority Data

Nov. 19, 1996 [JP] Japan ..... 8-308123

[51] Int. Cl.[6] ..... G03C 1/035; G03C 1/043; G03C 1/047

[52] U.S. Cl. ..... 430/569; 430/627; 430/628; 430/642

[58] Field of Search ..... 430/567, 569, 430/627, 628, 642

[56] References Cited

U.S. PATENT DOCUMENTS 3,118,766 1/1964 Roth ..... 430/642
4,713,320 12/1987 Maskasky ..... 430/567
5,587,281 12/1996 Saitou et al. ..... 430/567

FOREIGN PATENT DOCUMENTS 5-12696 2/1993 Japan .
8-82883 3/1996 Japan .

*Primary Examiner*—John A. McPherson
*Attorney, Agent, or Firm*—Sughrue, Mion, Zinn Macpeak & Seas, PLLC

[57] ABSTRACT

A process for producing tabular silver halide grains in a dispersion medium solution, wherein the dispersion medium comprises a gelatin derivative containing at least two carboxyl groups (—COOH) which are newly introduced through chemical modification of amino groups (—$NH_2$) of gelatin molecule, thereby monodisperse tabular silver halide grains small in thickness and large in aspect ratio are provided.

9 Claims, 2 Drawing Sheets

PROCESS FOR PRODUCING TABULAR SILVER HALIDE GRAINS

FIELD OF THE INVENTION

The present invention relates to a process for producing a silver halide emulsion and especially a photographic tabular silver halide grain emulsion.

BACKGROUND OF THE INVENTION

A silver halide grain containing two or more parallel twin planes has a tabular form (Hereinafter referred to as a "tabular grain"). The tabular grain possesses the following photographic characteristics:

1. The tabular grain is large in ratio of the surface area to the volume thereof (hereinafter referred to as a "specific surface area") and can adsorb a large amount of a sensitizing dye on the surface. As a result, the tabular grain has a relatively high spectral sensitivity to color sensitization.
2. When an emulsion containing such tabular grains is applied to a support surface and dried, the grains are arranged in parallel on the support surface to reduce light scattering which is caused by the grains, which results in improvement in sharpness and resolution. Further, this arrangement makes it possible to reduce the thickness of a coating layer and consequently to improve sharpness.
3. The large specific surface area can accelerate rate of development.
4. The tabular grains have strong covering power to attain high silver saving.

Because of such the many advantages, the tabular grains have hitherto been used for commercially available photosensitive materials of high sensitivity.

Emulsion grains with aspect ratios of 8 or more are disclosed by JP-A-58-113926 (The term "JP-A" as used herein means an "unexamined published Japanese patent application"), JP-A-58-113927, and JP-A-58-113928. The term, "aspect ratio" herein indicates a ratio of the diameter to the thickness of a tabular grain. In addition, the diameter herein means a diameter of a circle equivalent in area to a projected area of the tabular grain (hereinafter referred to as a "projected area diameter"). The thickness is indicated by a distance between two parallel main planes which constitute the tabular grain.

The advantages of the tabular grains as described above can be fully utilized because the tabular grains with larger aspect ratios have larger specific surface areas. Various attempts to reduce the thickness of the tabular grains have been made in order to increase the aspect ratio. A process for preparing tabular grains small in thickness by using as a dispersion medium gelatin whose methionine groups in the gelatin molecule are invalidated by hydrogen peroxide or the like is disclosed in JP-B-5-12696 (the term "JP-B" as used herein means an "examined Japanese patent publication"). In addition, JP-A-8-82883 discloses a process for preparing thin tabular grains by using as a dispersion medium gelatin whose amino groups and methionine groups are invalidated. Further, U.S. Pat. No. 5,380,642 and JP-A-8-292508 disclose a process for preparing thin tabular grains by using a synthetic polymer as a dispersion medium.

Various attempts to prepare monodisperse tabular grains have hitherto been made and some of them are disclosed in JP-A-52-153428, JP-A-55-142329, JP-A-51-39027, JP-A-61-112142, and French Patent 2,534,036. Further, JP-A-63-11928, JP-A-63-151618, and JP-A-2-838 disclose monodisperse tabular grains including hexagonal tabular grains. These patent applications disclose that the hexagonal tabular grains, different from triangular tabular grains, form monodisperse tabular grains in which the ratio of projected areas of the tabular grains with two parallel twin planes to the total projected areas is 99.7% and the coefficient of variation in circle-corresponding diameters is 10.1%.

However, tabular grains which are small in thickness and large in aspect ratio have a broad distribution of projected area diameters and it has been difficult to produce a monodisperse emulsion from such the tabular grains.

On the other hand, U.S. Pat. Nos. 5,147,771, 5,171,659, 5,147,772, and 5,147,773 and European Patent 514,742A disclose a process for preparing monodisperse tabular grains by allowing a polyalkylene oxide block copolymer to be present in emulsion at the nucleation stage in which the monodisperse tabular grains thus formed have a variation coefficient in circle-corresponding diameter of 4.7%. In addition, JP-A-7-28183 and JP-A-7-98482 also disclose a process for preparing monodisperse tabular grains by use of a synthetic polymer. Although these techniques have realized the production of tabular grains which are small in thickness and excellent in monodispersibility in the AgBr system, the AgBrI system still has difficulty in compatibility of monodispersibility with thinning of tabular grains.

SUMMARY OF THE INVENTION

An object of the present invention is to provide a process for preparing an emulsion comprising tabular grains which are small in thickness (that is, large in aspect ratio) and monodisperse in distribution of projected area diameters.

The object of the present invention can be achieved by techniques described below:

(1) A process for producing tabular silver halide grains in the presence of a gelatin derivative which contains at least two carboxyl groups (—COOH) introduced newly in place of amino groups (—$NH_2$) of gelatin through chemical modification of the amino groups in the gelatin molecule.

(2) The process as described in the above item (1), wherein said chemical modification is carried out by using trimellitic acid anhydride.

(3) The process as described in the above item (1), wherein said chemical modification is carried out by using pyromellitic acid anhydride.

(4) The process as described in the above item (1), wherein the modification ratio of said amino groups (—$NH_2$) is 50% or more.

(5) The process for producing tabular silver halide grains as described in the above item (1), wherein a dispersion medium contains at least one polymer with repeating units represented by formula (1):

$$-(R—O)_n- \quad (1)$$

wherein R represents an alkylene group having 2 to 10 carbon atoms; and n represents an average number of the repeating units ranging from 4 to 200.

DETAILED DESCRIPTION OF THE INVENTION

Figure 1:
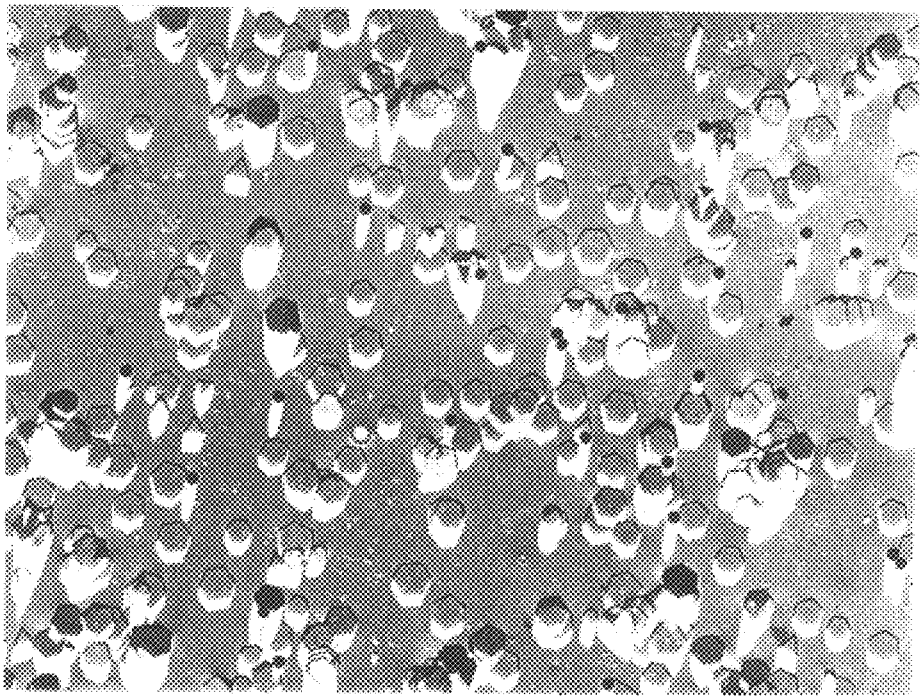
FIG. 1 PRIOR ART
FIG. 1 is an electron microphotograph at magnification of ×3300 which shows crystal structures of the silver halide grains prepared in Comparative Example 1.

The silver halide emulsions thus prepared are those comprising dispersion mediums and silver halide grains. In the emulsions, tabular grains which have two or more parallel twin planes as main planes occupy 80% of the total projected areas of said silver halide grains. In addition, said tabular grains characteristically have a hexagonal shape and are monodisperse in size distribution thereof.

The hexagonal tabular grains of the present invention mean tabular grains which are not more than 2 in ratio in length between arbitrary two adjacent sides of hexagonal six sides.

In the present invention, the thickness of the hexagonal tabular grains ranges from 0.01 $\mu$m to 0.2 $\mu$m and preferably from 0.02 $\mu$m to 0.15 $\mu$m.

The hexagonal tabular grains of the present invention characteristically are monodisperse. The monodispersibility is herein represented by a coefficient of variation of the projected area diameters. In the present invention, the monodispersibility of the tabular grains is 30% or less and preferably from 5% to 25% in the coefficient of variation.

In the present invention, the average aspect ratio of the hexagonal tabular grains is from 2 to 60 and preferably from 3 to 50. The term "average aspect ratio" herein means an average value of aspect ratios of all tabular grains of not less than 0.2 $\mu$m diameter which are present in emulsion.

At first, gelatin derivatives used mainly in the present invention which are prepared by modifying amino groups of gelatin are described.

JP-A-8-82883 describes gelatin derivatives for tabular grain formation which are prepared by modifying the amino groups. According to said specification, the formation of tabular grains which are small in thickness is achieved by converting primary amino groups (—$NH_2$) in the gelatin molecule into secondary amino groups (—NH—) and tertiary amino groups or by deamination of the primary amino groups. Further, according to the present invention, when gelatin is subjected to reaction with an acid anhydride, such as phthalic acid anhydride, succinic acid anhydride, or maleic acid anhydride, the amino groups of the gelatin are modified so that one carboxyl group (—COOH) is introduced in place of one amino group (—$NH_2$). In the present invention, an attempt to increase the number of carboxyl groups in gelatin has been made in view of the effect of carboxyl groups thus introduced. As a result, further reduction in thickness of tabular grains has been observed.

This phenomenon is understood as follows.

A carboxyl group (—COOH) is usually dissociated into —$COO^-$ at pH 4 or higher. In general, formation of silver halide grains is performed in an excess of halide ions over silver ions and the halide ions are considered to be adsorbed on surfaces of the silver halide grains (as described in E. Moisar and E. Klein, *Bunsenges. Phys. Chem.*, vol. 67, page 949 (1963)). Consequently, the repulsion between negative charged carboxylic ions (—$COO^-$) of the modified gelatin molecules and the halide ions on the surfaces of the silver halide grains is considered to control adsorption of the modified gelatin molecules to the silver halide grains (as described in Suzuki, Morita, and Nishio, *Nippon Shashin Gakkaishi* (*Journal of Japanese Photographic Society*), vol. 58, page 25 (1995)). It is thought that, if growth of the tabular grains in the lateral direction is assumed to vary depending on the adsorbability of gelatin, reduction in adsorbability of the modified gelatin molecules causes decrease in thickness of the tabular grains.

Further, use of the gelatin of the present invention for growth of tabular grains has resulted in formation of tabular grains which are small in thickness and narrow in distribution of the projected area diameters.

In order to introduce carboxyl groups into gelatin, reaction reagents are added to gelatin to modify the amino groups (—$NH_2$) thereof. Examples of the reaction reagents used for this purpose include compounds as given below but are not limited to these compounds.

(1) Compounds containing at least two carboxyl groups (—COOH) which can form at least one acid anhydride moiety in molecules. Examples of such compounds include trimellitic acid anhydride, pyromellitic acid anhydride, and mellitic acid anhydride.

(2) Compounds containing at least two carboxyl groups and at least one cyanate group in molecules. Example of such the compounds is phenyl isocyanate.

(3) Compounds containing at least two carboxyl groups and at least one aldehyde group or ketone group in molecules.

(4) Compounds containing at least two carboxyl groups and at least one imidoester moiety in molecules.

About the $\epsilon$-amino groups ($\epsilon$-$NH_2$) of lysine residues in gelatin molecules, the displacement ratio (i.e., the modification ratio) of the amino groups is 50% or more, preferably 70% or more, and more preferably 90% or more; and about all amino groups in the gelatin molecule ($\alpha$-$NH_2$, $\epsilon$-$NH_2$, and guanidyl groups), the displacement ratio of the amino groups is 30% or more and preferably 50% or more.

One of processes for preparing the gelatin of the present invention is described below. However, processes utilized in present invention are not limited to the process exemplified.

Various procedures have hitherto been exploited for modification of the amino groups. For example, descriptions in U.S. Pat. Nos. 2,525,753, 3,118,766, 2,614,928, 2,614,929, JP-B-40-15585, JP-A-8-82883, and *Nippon Shashin Gakkaishi* (*Journal of Japanese Photographic Society*), vol. 58, page 25 (1995) can be referred to for the procedures.

The preparation of trimellitylated gelatin, one of gelatin derivatives of the present invention, can be achieved according to a method described in the above-mentioned *Nippon Shashin Gakkaishi*, vol. 58, page 25 (1995); A 15% aqueous solution of gelatin maintained at 60° C. was adjusted to pH 9.0 and an aqueous solution of trimellitic acid anhydride was added to the gelatin solution. The resulting mixture was allowed to react for 1 hour, while maintaining the mixture at pH 8.75 to 9.25. After completing the reaction, the reaction mixture was subjected to deionization by ultrafiltration, adjusted to pH 6.0, and then dried to obtain gelatin powder.

Also, an example of preparation method of pyromellitylated gelatin which is one of the gelatin derivatives of the present invention is shown below.

A 15% aqueous solution of gelatin maintained at 60° C. was adjusted to pH 9.0 and an aqueous solution of pyromellitic acid anhydride was added to the gelatin solution. The resulting mixture was allowed to react for 1 hour, while maintaining the mixture at pH 8.75 to 9.25. After completing the reaction, the reaction mixture was subjected to deionization by ultrafiltration, adjusted to pH 6.0, and then dried to obtain gelatin powder.

Second, polymers used for silver halide emulsions of the present invention are described in detail below.

The polymers used for formation of the tabular grain emulsions of the present invention are those which contain repeating units represented by formula (1):

$$-(R-O)_n- \quad (1)$$

wherein R represents an alkylene group having 2 to 10 carbon atoms; and n represents an average number of the repeating units ranging from 4 to 200.

Although the polymers containing the repeating units represented by formula (1) can be preferably used in the formation of the emulsions of the present invention, vinyl polymers which contain as a constituent component at least one monomer represented by formula (2) or polyurethanes represented by formula (3) are more preferably used. Further, the vinyl polymers which contain as a constituent component at least one monomer represented by formula (2) are particularly preferred.

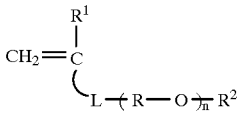

(2)

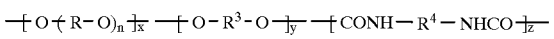

(3)

In formulas (2) and (3), R represents an alkylene group having 2 to 10 carbon atoms; n represents an average number of the repeating units ranging from 4 to 200; $R^1$ represents a hydrogen atom or a lower alkyl group. $R^2$ represents a monovalent substituent group; L represents a divalent linking group; $R^3$ and $R^4$ each represent an alkylene group having 1 to 20 carbon atoms, a phenylene group having 6 to 20 carbon atoms, or aralkylene group having 7 to 20 carbon atoms; and x, y, and z each represent the weight percent of the respective components, x is from 1 to 70, y is from 1 to 70, z is from 20 to 70, wherein x+y+z=100.

Examples of the above-mentioned polymers are given below. However, the polymers used in the present invention are not limited to the polymers exemplified. Further, detailed examples and general descriptions regarding the polymers are given in Japanese Patent Application No. 8-113454.

P-1

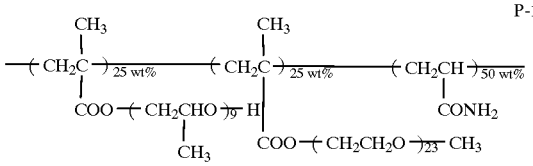

P-2

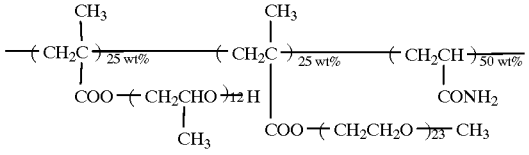

-continued

P-3

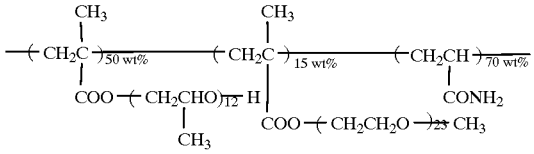

P-4

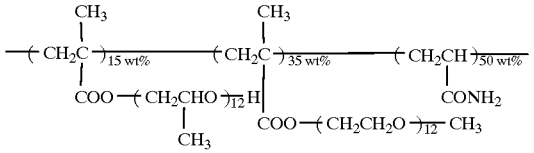

P-5

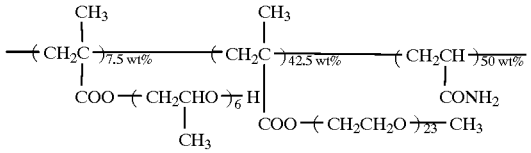

Preferred examples of the polymers containing the repeating units represented by formula (1) include polyalkylene oxide block polymers represented by formulas (4) and (5):

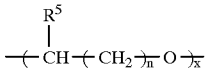

(4)

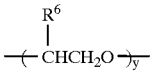

(5)

In formulas (4) and (5), $R^5$ represents a hydrogen atom, an alkylene groups having 1 to 10 carbon atoms, or an aryl group having 6 to 10 carbon atoms; n represents an integer of 1 to 10. When n is 1, $R^5$ can not be a hydrogen atom. $R^6$ represents a hydrogen atom or a lower alkyl group having not more than 4 carbon atoms which is substituted by a hydrophilic group. x and y represent the numbers of repeating units (number average polymerization degrees).

Examples of the above-mentioned block polymers are given below. However, the block polymers used in the present invention are not limited to the polymers exemplified. More detailed examples and general descriptions regarding these polymers are given in European Patents 513,722, 513,723, 513,724, 513,735, 513,742, 513,743, and 518,066 and Japanese Patent Application No. 8-113454.

B-1

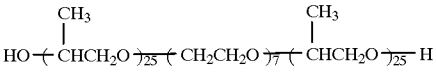

B-2

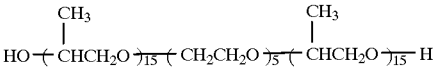

-continued

B-3

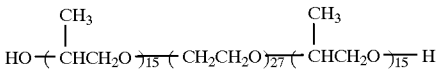

Next, the preparation of the silver halide emulsions of the present invention is described below.

The preparation of the silver halide emulsions can be performed in the order of nucleation, ripening, and growth.

The gelatin of the present invention need to be present in a dispersion medium at least before the growth stage of the grain formation, preferably immediately after the nucleation stage, and more preferably before the nucleation stage. The amount of the gelatin of the present invention is 60% or more, preferably 80% or more, and more preferably 90% or more, based on the entire dispersion medium used in the grain formation. Use of the gelatin of the present invention results in formation of tabular grains which are small in thickness and monodisperse.

In grain formation by use of the gelatin of the present invention, the presence of the water-soluble polymers represented by formula (1) leads to improvement in monodispersibility of the tabular grains formed. The water-soluble polymers represented by formula (1) can be added at any stage of the grain formation. However, it is desirable that the polymers are present in a dispersion medium at least before the growth stage, preferably before the ripening stage, and more preferably before the nucleation stage. The amount of the polymers is from 0.1 to 50 times by weight, preferably from 0.1 to 30 times by weight, based on silver nitrate used in the nucleation.

The respective stages of the nucleation, ripening, and growth are described below.

1. Nucleation

The nucleation for the tabular grains is carried out in general by the double jet method of adding an aqueous solution of a silver salt and an aqueous solution of an alkali halide to an aqueous solution of gelatin which is placed in a reaction vessel or by the single jet method of adding an aqueous solution of a silver salt to a gelatin solution containing an alkali halide. In addition, a method of adding an aqueous solution of an alkali halide to a gelatin solution containing a silver salt can also be utilized as needed. Further, the nucleation of the tabular grains can also be achieved as needed by loading a gelatin solution, a silver salt solution, and an alkali halide solution into a mixer disclosed by JP-A-2-44335 followed by transferring immediately to a reaction vessel. Furthermore, the nucleation can also be achieved as needed by passing an aqueous solution containing an alkali halide and a protective colloid through a pipe followed by introducing an aqueous solution of a silver salt into the pipe as disclosed by U.S. Pat. No. 5,104,786.

In the nucleation, dispersion medium formation is preferably performed at pBr 1 to 4 with use of gelatin as a dispersion medium. Although the gelatin of the present invention is preferably used for this purpose, alkali-treated gelatin, low molecular weight gelatin (molecular weight: 3000 to 40,000), and oxidation-treated gelatin can also be used. Or the gelatin of the present invention can be simultaneously used with those kinds of gelatin. When the gelatin of the present invention is simultaneously used, the amount of the gelatin of the present invention is 20% or more, preferably 50% or more, and more preferably 80% or more, based on the entire dispersion medium.

The concentration of the dispersion mediums is preferably 10% by weight or less and more preferably 1% by weight or less.

The nucleation temperature is preferably from 5 to 60° C. When fine tabular grains having an average grain size of 0.5 μm or less are prepared, the nucleation temperature is more preferably from 5 to 48° C.

When the gelatin of the present invention is used, the pH of the dispersion mediums is preferably from 4 to 10. When other gelatin than the gelatin of the present invention is used, the pH is preferably from 2 to 10.

In the composition of alkali halide solutions added, the ratio of iodide ion ($I^-$) to bromide ion ($Br^-$) is the limit of solid solution or less of silver bromide iodide (AgBrI) formed and preferably 10 mol % or less.

2. Ripening

In the nucleation described in the above item 1, fine grains (particularly, octahedron and single twin grains) other than the tabular grains also are formed. It is necessary to eliminate such grains other than the tabular grains and to leave nuclei which have shapes to grow into the tabular grains and give good monodispersibility prior to the growth stage described in the following item. For this purpose, it is well known that the Ostwald ripening is successively performed after the nucleation.

The pBr of dispersion medium solutions which have undergone the nucleation is adjusted immediately after the nucleation and the ripening is performed at a raised temperature until hexagonal tabular grains acquire the highest ratio. At that time, a gelatin solution can be supplemented. Then, the concentration of gelatin in the dispersion medium solutions is preferably 10% by weight or less. Although the gelatin supplemented is preferably the gelatin of the present invention, alkali-treated gelatin and oxidation-treated gelatin may also be used for this purpose.

The ripening temperature is from 40 to 80° C. and preferably from 50 to 80° C. The pBr of the dispersion medium solutions is from 1.2 to 3.0. When the gelatin of the present invention is present in the dispersion medium solutions, the pH thereof is preferably from 4 to 10. When other kinds of gelatin than the gelatin of the present invention are used, the pH thereof is preferably from 2 to 8.

In order to rapidly eliminate other grains than the tabular grains, silver halide solvents can be added to the dispersion medium solutions. The concentration of the silver halide solvents is preferably 0.3 mol/liter or less and more preferably 0.2 mol/liter or less. When the resulting emulsions are directly used as reversal emulsions, the silver halide solvents used preferably are thioether compounds and the like which are used in the neutral or acidic side rather than ammonia which is used in the alkali side.

Almost 100% tabular grains are left by this ripening.

When the silver halide solvents are not necessary at the next growth stage, the solvents are removed after ripening in the following manner.

(1) Alkaline silver halide solvents such as ammonia are invalidated by acids such as nitric acid ($HNO_3$) which have large solubility products to silver ion ($Ag^+$).

(2) Thioether-series silver halide solvents are invalidated by oxidizing agents such as hydrogen peroxide ($H_2O_2$) as described in JP-A-60-136736.

3. Growth

In the crystal growth stage which follows the ripening stage, the pBr of the dispersion medium solutions is preferably maintained at 1.4 to 3.5. When the gelatin concentration in the dispersion medium solutions is low (i.e., not more than 1% by weight), gelatin can be supplemented in some cases before the growth stage. At that time, the gelatin concentration in the dispersion medium solutions is preferably adjusted to 1 to 10% by weight. The gelatin to be supplemented is the gelatin of the present invention. The pH of the dispersion medium solutions at the growth stage is from 4 to 10 and preferably from 5 to 8. It is preferred to adjust the addition speeds of silver ion ($Ag^+$) and halide ion so that the crystal growth speed ranges from 20 to 100% and preferably from 30 to 100% of the crystal critical growth speed. In this case, although the addition speeds of silver ion and halide ion must be increased with proceeding of crystal growth, operation for this can be performed either by increasing the addition speeds of both an aqueous solution of a silver salt and an aqueous solution of a halide salt or by increasing the concentrations of these aqueous solutions as described in JP-B-48-36890 and JP-B-52-16364.

It is preferred that the iodine content of silver halides which are deposited on nuclei at the growth stage ranges from 0 mol % to the limit of solid solution.

Examples of silver halides used in the present invention include silver bromide, silver iodide bromide, and silver chlorobromide and silver chlorobromoiodide which have silver chloride content of not more than 30 mol %.

In the present invention, use of other constituent components for emulsion layers of silver halide photographic materials is not particularly limited and various additives can be used as needed.

Descriptions in *Research Disclosure*, vol. 176, 1978, December (Item 17643); ibid, vol. 184, 1979, August (Item 18431); ibid, vol. 134, 1975, June (Item 13452); *Product Licensing Index*, vol. 92, page 107–110 (1971, December); JP-A-58-113926 to 113928; JP-A-61-3134; JP-A-62-6251; *Nippon Kagakukyokai Geppo,* 1984, December, page 18–27; JP-A-62-219982; T. H. James, *The Theory of The Photoaraphic Process*, Fourth Edition, Macmillan, New York, 1977; and V. L. Zelikman, et al., *Making and Coating Photographic Emulsion*, The Focal Press, 1964, will be helpful for addition of chemical sensitizers, spectral sensitizers, antifoggants, metallic ion dopants, silver halide solvents, stabilizers, dyes, color couplers, DIR couplers, binders, hardening agents, coating aids, thickeners, emulsion precipitants, plasticizers, dimensional stability improvers, antistatic agents, fluorescent brightening agents, lubricants, surfactants, ultraviolet absorbing agents, scattering and absorbing materials, hardeners, adhesion-preventing agents, photographic characteristic improvers (for example, development accelerators and contrast-increasing agents), couplers which release photographically advantageous fragments such as developing agents (for example, development inhibitors and accelerators, bleach accelerators, developing agents, silver halide solvents, toners, hardening agents, antifoggants, competing couplers, chemical and spectral sensitizers, and desensitizers), image dye stabilizers, and autocontrol developing agents and the use thereof; hypersensitization in spectral sensitization, the halogen acceptor effect and electron acceptor effect of spectral sensitizing dyes, actions of antifoggants, stabilizers, and development accelerators and inhibitors, and others; production apparatuses used for producing the emulsions of the present invention, reactors, agitators, coating methods, drying methods, exposure methods (light sources, exposure atmospheres, and exposure techniques); and photographic supports, microporous supports, constitution of layers such as undercoat layers, surface protective layers, matte layers, interlayers, antihalation layers, silver halide emulsion layers, and photographic processing agents and methods.

One or more silver halide emulsion layers of the present invention can be provided on a support together with other emulsions as needed. The layers can be formed not only on one side of the support but also on both sides thereof. Further, emulsions which have different color sensitivities can also be formed into multiple layers.

The silver halide emulsions of the present invention can be used for black and white silver halide photographic materials (for example, X-ray photosensitive materials, lithographic photosensitive materials, and negative films for black-and-white photography) and color photographic materials (for example, color negative films, color reversal films, and color papers). In addition, the silver halide emulsions of the present invention can also be used for diffusion transfer photosensitive materials (for example, color diffusion transfer elements and silver salt diffusion transfer elements) and heat-developable photosensitive materials (black-and-white and color).

EXAMPLE

Although the present invention is described in more detail by means of Examples, the embodiments of the present invention are not limited to these examples.

COMPARATIVE EXAMPLE 1

One liter of a dispersion medium solution (pH=5) containing 0.38 g of KBr and 0.5 g of low molecular weight gelatin (molecular weight: 15,000) was maintained at 40° C. in a reaction vessel and 20 ml of a 0.29 mol/liter silver nitrate solution and 20 ml of a 0.29 mol/liter potassium bromide solution were then added with stirring to the dispersion medium solution over a 40-second period by the double jet method. Thereafter, the temperature of the dispersion medium solution was raised to 75° C. over a 15-minute period. After an elapse of 15 minutes after the temperature was raised, dispersion medium solution (A) comprising 35 g of alkali-treated gelatin and 250 ml of water was newly added to the obtained dispersion medium solution. The resulting solution was then adjusted to pH 6. Thereafter, 734 ml of an 1.2 mol/liter silver nitrate solution was added to the solution at an accelerated flow rate, while adding a potassium bromide solution thereto so as to be maintained at pBr 2.93.

COMPARATIVE EXAMPLE 2

Grain formation was carried out in the same manner as in Comparative Example 1, except that a dispersion medium solution containing 35 g of oxidation-treated gelatin and 250 ml of water was used in place of dispersion medium solution (A) in Comparative Example 1. The oxidation-treated gelatin herein means gelatin which is prepared by oxidizing completely the methionine moieties of alkali-treated gelatin with hydrogen peroxide.

COMPARATIVE EXAMPLE 3

Grain formation was carried out in the same manner as in Comparative Example 1, except that a dispersion medium solution containing 35 g of phthalylated gelatin and 250 ml ml of water was used in place of dispersion medium solution (A) in Comparative Example 1. The phthalylated gelatin herein means gelatin which is prepared by displacing amino groups of alkali-treated gelatin with phthalic anhydride by 98%.

EXAMPLE 1

Grain formation was carried out in the same manner as in Comparative Example 1, except that a dispersion medium solution containing 35 g of trimellitylated gelatin and 250 ml of water was used in place of dispersion medium solution (A) in Comparative Example 1. The trimellitylated gelatin herein means gelatin which is prepared by displacing amino groups of alkali-treated gelatin with trimellitic acid anhydride by 99%.

EXAMPLE 2

Grain formation was carried out in the same manner as in Comparative Example 1, except that a dispersion medium solution containing 35 g of pyromellitylated gelatin and 250 ml of water was used in place of dispersion medium solution (A) in Comparative Example 1.

The pyromellitylated gelatin herein means gelatin which is prepared by displacing amino groups of alkali-treated gelatin with pyromellitic acid anhydride by 99%.

Figure 2:
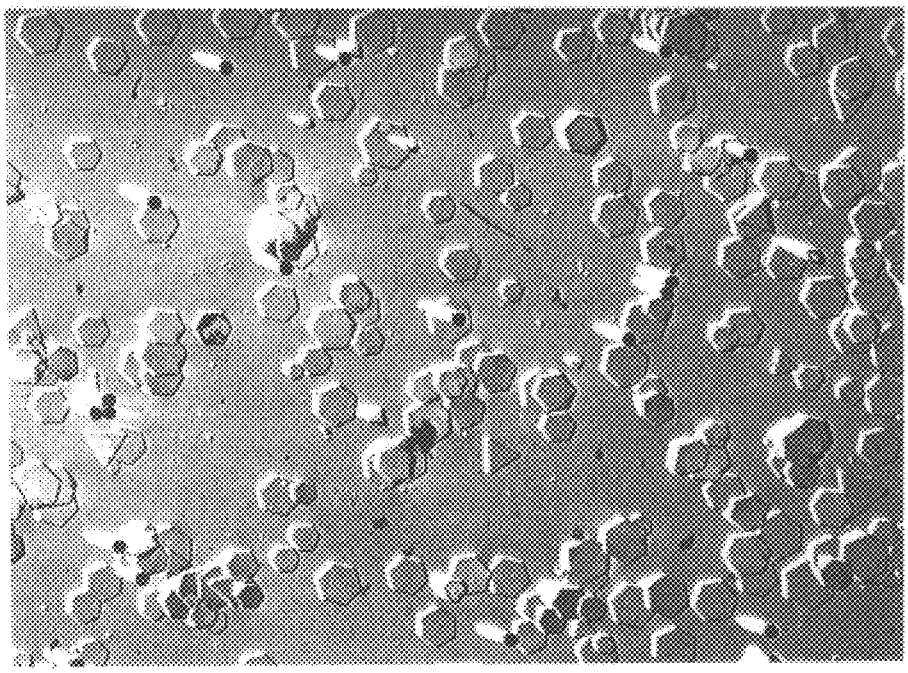
FIG. 2 PRIOR ART
FIG. 2 is an electron microphotograph at magnification of ×3300 which shows crystal structures of the silver halide grains prepared in Comparative Example 2.
Figure 3:
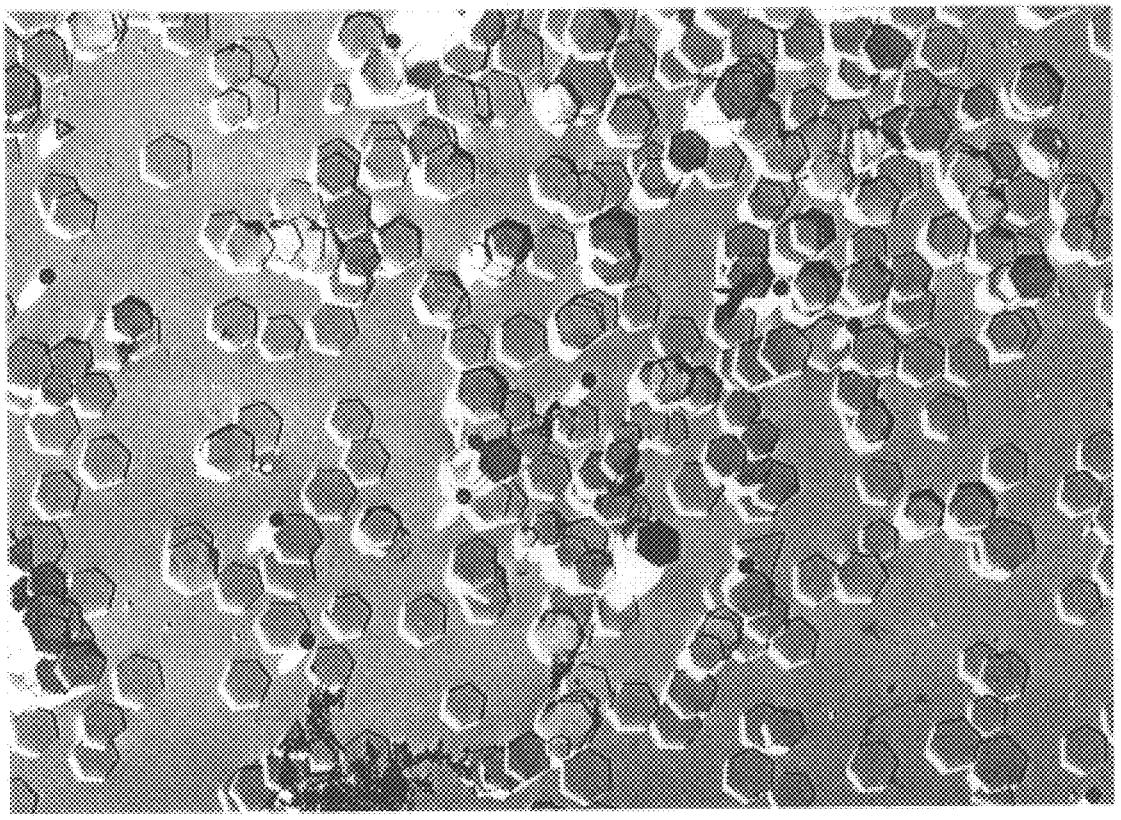
FIG. 3 is an electron microphotograph at magnification of ×3300 which shows crystal structures of silver halide grains prepared in Example 1.

All grains formed in Comparative Examples 1, 2 and 3, and Examples 1 and 2 are hexagonal tabular grains of silver bromide (AgBr) having (111) faces as main planes. Replica photographs of the grains obtained in Comparative Examples 1 and 2 and Example 1 are shown in FIG. 1 to FIG. 3 (i.e., Photographs 1 to 3), respectively. The sizes and size distributions of the grains are given in Table 1.

TABLE 1

| | Projected Area Diameters | Thickness |
|---|---|---|
| Comparative Example 1 | 1.12 μm (13.4%) | 0.43 μm |
| Comparative Example 2 | 1.23 μm (22.4%) | 0.09 μm |
| Comparative Example 3 | 1.22 μm (12.1%) | 0.11 μm |
| Example 1 | 1.34 μm (11.7%) | 0.09 μm |
| Example 2 | 1.33 μm (12.3%) | 0.09 μm |

*Figures in parentheses indicate coefficients of variation.

In the trimellitylated gelatin, the gelatin of the present invention (Example 1), carboxyl groups which are introduced into gelatin by displacing the amino groups thereof are doubled in number, as compared with the phthalylated gelatin used in Comparative Example 3.

In the pyromellitylated gelatin, the gelatin of the present invention (Example 2), carboxyl groups which are introduced into gelatin by displacing the amino groups thereof are tripled in number, as compared with the phthalylated gelatin used in Comparative Example 3. As is apparent from the results of Table 1, the trimellitylated gelatin led to formation of tabular grains which are smaller in thickness than the conventional phthalylated gelatin. This shows that, as the number of carboxyl groups introduced by displacing the amino groups increases, the thickness of the tabular grains decreases because of reduced adsorbability of the gelatin molecules.

In addition, the conventional oxidation-treated gelatin yielded tabular grains which were small in thickness but broad in distribution of projected area diameters, whereas the trimellitylated gelatin and pyromellitylated gelatin of the present invention gave tabular grains which were equivalent or small in thickness to the oxidation-treated gelatin and narrow in distribution of projected area diameters.

COMPARATIVE EXAMPLE 4

One liter of a dispersion medium solution (pH=5) containing 0.38 g of potassium bromide and 0.5 g of low molecular weight gelatin (molecular weight: 15,000) was maintained at 40° C. in a reaction vessel and 20 ml of a 0.29 mol/liter silver nitrate solution and 20 ml of a 0.29 mol/liter potassium bromide were added with stirring to the dispersion medium solution over a 40-second period by the double jet method. Thereafter, the temperature of the resulting dispersion medium solution was raised to 75° C. over a 15-minute period. After an elapse of 15 minutes after the temperature was raised, dispersion medium solution (A) containing 35 g of alkali-treated gelatin and 250 ml of water was newly added to the obtained dispersion medium solution. The resulting dispersion medium solution was then adjusted to pH 6. Thereafter, 734 ml of an 1.2 mol/liter silver nitrate solution was added to the solution at an accelerated flow rate, while adding thereto a mixture of a potassium bromide solution and a potassium iodide solution so as to be maintained at pBr 2.93. At that time, the potassium iodide solution in an amount of 3 mol %, based on an amount of silver added, was mixed with the potassium bromide solution.

COMPARATIVE EXAMPLE 5

Grain formation was carried out in the same manner as in Comparative Example 4, except that a dispersion medium solution containing 35 g of oxidation-treated gelatin and 250 ml of water was used in place of dispersion medium solution (A) in Comparative Example 4. The oxidation-treated gelatin herein means gelatin which is prepared by oxidizing completely the methionine moieties of alkali-treated gelatin with hydrogen peroxide.

EXAMPLE 3

Grain formation was carried out in the same manner as in Comparative Example 4, except that a dispersion medium solution containing 35 g of trimellitylated gelatin and 250 ml of water was used in place of dispersion medium solution (A) in Comparative Example 4. The trimellitylated gelatin herein means gelatin which is prepared by displacing amino groups of alkali-treated gelatin with trimellitic acid anhydride by 99%.

EXAMPLE 4

Grain formation was curried out in the same manner as in Comparative Example 4, except that a dispersion medium solution containing 35 g of pyromellitylated gelatin and 250 ml of water was used in place of dispersion medium solution (A) in Comparative Example 4. The pyromellitylated gelatin herein means gelatin which is prepared by displacing amino groups of alkali-treated gelatin with pyromellitic acid anhydride by 99%.

The grains formed in Comparative Examples 4 and 5, and Examples 3 and 4 were hexagonal tabular silver bromoiodide (AgBrI) grains having (111) faces as main planes. The sizes and size distributions of the grains are given in Table 2. As a result, by use of the trimellitylated gelatin and pyromellitylated gelatin of the present invention, respectively, the tabular grains which are small in thickness and monodisperse were obtained.

TABLE 2

| | Projected Area Diameters | Thickness |
|---|---|---|
| Comparative Example 4 | 1.12 μm (16.2%) | 0.15 μm |
| Comparative Example 5 | 1.23 μm (25.6%) | 0.10 μm |

TABLE 2-continued

| | Projected Area Diameters | Thickness |
|---|---|---|
| Example 3 | 1.33 μm (12.6%) | 0.10 μm |
| Example 4 | 1.34 μm (12.3%) | 0.10 μm |

*Figures in parentheses indicate coefficients of variation.

EXAMPLE 5

The same procedure as in Example 1 was carried out, except that 50 ml of a 4% aqueous solution of synthetic polymer (P-1) of the present invention were added immediately after the temperature of the dispersion medium solution was raised to 75° C.; and the solution was adjusted to pH 9.

EXAMPLE 6

The same procedure as in Example 1 was followed, except that 50 ml of a 0.22% aqueous solution of a synthetic polymer (PLURONIC TM31R1 manufactured by BASF., Corresponding to compound B-1 of the present invention) were added immediately after the temperature of the dispersion medium solution was raised to 75° C.; and the solution was adjusted to pH 9.

The grains formed in Examples 5 and 6 were hexagonal tabular silver bromide grains which had (111) faces as main planes. The sizes and size distributions of the grains are given in Table 3.

TABLE 3

| | Projected Area Diameters | Thickness |
|---|---|---|
| Example 5 | 1.20 μm (7.6%) | 0.11 μm |
| Example 6 | 1.18 μm (8.1%) | 0.11 μm |

*Figures in parentheses indicate coefficients of variation.

EXAMPLE 7

After grain formation was achieved in the same manner as in Example 1, the resulting dispersion medium solution was cooled to 35° C. The grains were washed by the flocculation method and then dispersed to prepare emulsion A.

EXAMPLE 8

Emulsion A prepared in Example 7 was subjected to chemical sensitization and spectral sensitization, used as the fifth layer of the photosensitive material, sample 6 (No. 101), in Example 3 of JP-A-6-258788, and then processed in the same manner as in the example to provide good performance.

EXAMPLE 9

Emulsion A prepared in Example 7 was subjected to chemical sensitization and spectral sensitization, used as the emulsion for photosensitive material X in Example 1 of JP-A-6-273866, and then processed in combination with screen B in the same manner as in the example to provide good performance.

EXAMPLE 10

Emulsion A prepared in Example 7 was subjected to chemical sensitization and spectral sensitization, used as the sixth layer of the photosensitive material (sample No. 101) in Example 1 of JP-A-2-854, and then processed in the same manner as in the example to obtain a good result.

While the invention has been described in detail and with reference to specific embodiments thereof, it will be apparent to one skilled in the art that various changes and modifications can be made therein without departing from the spirit and scope thereof.

What is claimed is:

1. A process for producing tabular silver halide grains comprising at least the steps of nucleating, ripening, and growing silver halide grains in a dispersion medium solution, wherein the dispersion medium comprises a gelatin derivative containing at least two carboxyl groups (—COOH) which are introduced through chemical modification of amino groups (—$NH_2$) of gelatin molecule, wherein the modification ratio of said amino groups (—$NH_2$) is 50% or more.

2. The process as claimed in claim 1, wherein said chemical modification is carried out by using trimellitic acid anhydride.

3. The process as claimed in claim 1, wherein said chemical modification is carried out by using pyromellitic acid anhydride.

4. The process as claimed in claim 1, wherein the dispersion medium comprises at least one polymer which contains repeating units represented by formula (1):

$$-(R—O)_n- \quad (1)$$

wherein R represents an alkylene group having 2 to 10 carbon atoms; and n represents the average number of the repeating units ranging from 4 to 200.

5. The process as claimed in claim 4, wherein the polymer containing the repeating units represented by formula (1) is a vinyl polymer which contains as a constituent component at least one monomer represented by formula (2) or at least one polymer selected from the group consisting of polyurethanes represented by formula (3):

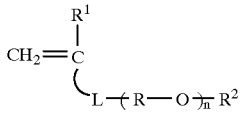

(2)

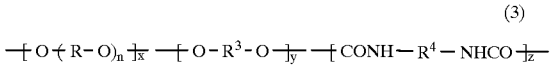

(3)

wherein R represents an alkylene group having 2 to 10 carbon atoms; n represents an average number of the repeating units ranging from 4 to 200; $R^1$ represents a hydrogen atom or a lower alkyl group; $R^2$ represents a monovalent substituent group; L represents a divalent linking group; $R^3$ and $R^4$ each represents an alkylene group having 1 to 20 carbon atoms, a phenylene group having 6 to 20 carbon atoms, or an aralkylene group having 7 to 20 carbon atoms; and x, y, and z each represent the weight percent of the respective components, x is from 1 to 70, y is from 1 to 70, and z is from 20 to 70, wherein x+y+z=100.

6. The process as claimed in claim 4, wherein the polymer containing the repeating units represented by formula (1) contains a polyalkylene oxide block polymer component represented by formula (4) or (5):

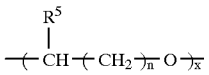

(4)

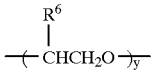

(5)

wherein $R^5$ represents a hydrogen atom, an alkyl group having 1 to 10 carbon atoms, or an aryl group having 6 to 10 carbon atoms; n represents an integer of from 1 to 10; and when n=1, $R^5$ is not a hydrogen atom; $R^6$ represents a hydrogen atom or a lower alkyl group having not more than 4 carbon atoms which is substituted by a hydrophilic group; and x and y each represent the number of repeating units (number average polymerization degree).

7. The process as claimed in claim 1, wherein the tabular silver halide grains have two or more parallel twin planes as main planes, are hexagonal tabular grains and are monodisperse in size distribution.

8. The process as claimed in claim 7, wherein the hexagonal tabular grains have a thickness of from 0.01 $\mu$m to 0.2 $\mu$m.

9. The process as claimed in claim 7, wherein the hexagonal tabular grains have an average aspect ratio of from 2 to 60.

* * * * *